United States Patent [19]

Jue

[11] 4,432,830

[45] Feb. 21, 1984

[54] LABEL PRINTER HAVING SELECTABLE LABEL STOCK PATHS

[75] Inventor: Clifford T. Jue, Edmonds, Wash.

[73] Assignee: Intermec Corporation, Lynnwood, Wash.

[21] Appl. No.: 464,206

[22] Filed: Feb. 7, 1983

[51] Int. Cl.[3] ..... B65C 9/18; B65C 9/46

[52] U.S. Cl. ..... 156/384; 101/288; 156/541; 156/584; 156/DIG. 33; 156/DIG. 47

[58] Field of Search ..... 156/384, 344, 541, 584, 156/DIG. 33, DIG. 47, 543; 101/288, 291, 292, 66–69

[56] References Cited

U.S. PATENT DOCUMENTS

| | | | |
|---|---|---|---|
| 2,522,224 | 9/1950 | Hedinger, Jr. | 156/384 |
| 3,530,028 | 9/1970 | Messmer | 156/584 |
| 3,660,203 | 5/1972 | Beck et al. | 156/584 |
| 4,036,132 | 7/1977 | Ellefson | 101/288 |
| 4,174,078 | 11/1979 | Brooks | 242/75.43 |
| 4,262,591 | 4/1981 | Cook | 400/124 |

*Primary Examiner*—Michael G. Wityshyn
*Attorney, Agent, or Firm*—Christensen, O'Connor, Johnson & Kindness

[57] ABSTRACT

In a label printer, nonspooling and self-strip paths of label stock movement are accommodated by a single mechanism that includes a drive capstan 46 and associated pinch roller 48, a shaft 40, a pair of mechanically intercoupled discs 68 and 52 respectively secured to the shaft and the drive capstan for causing them to rotate in opposite directions, a label stripping pin 44, a drive roller 38 rotatable about the shaft, a clutch 78 locking the drive roller to the shaft whenever the shaft is rotated in a given direction and permitting the drive roller to freely rotate about the shaft whenever the shaft is rotated in an opposite direction, and a thermal print head 28 including a thermal print element 30 yieldably engaging the drive roller. In the nonspooling path, the free end of the label stock is passed between the thermal print head and the drive roller and the drive capstan is rotated in a given direction by a drive motor 54 so that the label stock exits the label printer without label separation. In the self-strip path, a free end of the label stock is further passed around the label stripping pin, over the drive roller, and between the drive capstan and associated pinch roller, and the drive capstan is caused to rotate by the drive motor in a direction opposite to that used for the nonspooling path so that each label is partially separated as the label stock passes over the label stripping pin.

19 Claims, 4 Drawing Figures

LABEL PRINTER HAVING SELECTABLE LABEL STOCK PATHS

FIELD OF THE INVENTION

This invention generally relates to label printers and, more particularly, to such a printer that prints a plurality of labels in succession as those labels are carried by an elongated strip of label stock backing.

BACKGROUND OF THE INVENTION

Label printers are known to the prior art for printing a succession of characters, which may be human-readable characters or machine-readable characters such as bar code characters, on a succession of labels which removably adhere to an elongated strip of label stock backing. These printers may be of the mechanical impact type in which printing is accomplished by mechanically impacting the label stock and an interposed ink ribbon against a raised print element on a rotating print wheel, or may be of the thermal type in which printing is accomplished by selectively heating the label to expose a thermally responsive layer thereon. In such printers, the label stock is moved past a print station where the characters are successively printed. After printing, the label stock is moved along various paths, depending upon the construction of the printer and the desired application. One of these paths may be termed a "spooling" path, in which the label stock is simply wound onto a take-up reel for subsequent dispensing of the printed labels. Another of these paths may be termed a "self-strip" path, in which each label is partially separated from the backing strip by a label stripping apparatus so that the label can be completely removed from the backing strip by hand and in which the backing strip is wound onto a take-up reel. Yet another path may be termed a "nonspooling" path, in which both the labels and the backing strip exit the printer without label separation.

In those prior label printers that accommodate both the nonspooling and self-strip paths, a drive capstan and a pinch roller are located downstream of the print station and separated therefrom by a considerable distance. When the label stock is to be moved along the nonspooling path, the label stock is passed directly to and threaded between the drive capstan and pinch roller. When the label stock is to be moved along the self-strip path, the label stock is first passed over the label stripping apparatus so that the label stock sharply changes its direction, then passed over an idler roller, and then passed to and threaded between the drive capstan and pinch roller.

This structure makes such label printers somewhat difficult to use. In the nonspooling path, the label stock must be moved by an amount equal to the separation between the print station and the drive capstan and pinch roller before any printed label can exit the printer. As a result, a printed label cannot be viewed until a number of blank labels are advanced through the print station. In the self-strip path, a printed label can be removed from the backing strip only by reaching into the printer.

The present invention is therefore directed to the provision of a single mechanism that accommodates both the nonspooling and self-strip paths of label stock movement in a manner such that any printed label may exit the printer immediately after passing through the print station.

SUMMARY OF THE INVENTION

Briefly, the invention resides in a label printer including a mechanism for providing selectable paths of label stock movement.

The mechanism comprises: a rotatable drive capstan; a rotatable pinch roller engaging the drive capstan; a rotatable shaft; drive means for rotating the drive capstan and the shaft in opposite directions; a drive roller rotatable about the shaft; clutch means for locking the drive roller to the shaft whenever the shaft is rotated in a given direction and for permitting the drive roller to freely rotate about the shaft whenever the shaft is rotated in an opposite direction; a label stripping pin; and, pressure means yieldably engaging the drive roller.

The aforementioned mechanism elements are disposed so that the label stock may be selectively moved in either a nonspooling path or a self-strip path.

In the nonspooling path, the free end of the label stock is threaded between the drive roller and the pressure means, and the drive means is caused to rotate the drive capstan and the drive roller in a first set of opposing directions so that the drive roller is locked to the shaft, whereupon the label stock is pulled by the pressure means and the drive roller and exits without label separation.

In the self-strip path, the free end of the label stock is threaded past the label stripping pin and between the drive capstan and pinch roller with a rear surface of the backing strip engaging the label stripping pin and with the backing strip being caused to sharply change direction as it passes over the label stripping pin. The drive means is caused to rotate the drive capstan and the drive roller in a second set of opposing directions so that the drive capstan and pinch roller pull the label stock and so that the drive roller freely rotates about the shaft, whereupon each label is partially separated from the backing strip as the backing strip passes over the label stripping pin.

The label printer may be a thermal printer in which the pressure means includes a thermal print head having a thermal print element yieldably engaging the drive roller.

The drive roller preferably includes a hollow cylinder of elastomeric material surrounding the shaft, the cylinder being supported for rotation about the shaft by bearing means disposed within the cylinder. In this case, the clutch means preferably includes an overrun clutch, such as a roller bearing clutch, that is secured to the cylinder, that surrounds the shaft, and that is also disposed within the cylinder.

The drive means preferably includes transmission means mechanically intercoupling the drive capstan and the shaft for rotation in opposite directions, such as a first disc secured to and rotatable with the shaft, a second disc secured to and rotatable with the drive capstan, and an elastomeric O-ring carried by the periphery of the second disc and engaging the periphery of the first disc.

BRIEF DESCRIPTION OF THE DRAWINGS

The invention can best be understood by reference to the following portion of the specification, taken in conjunction with the accompanying drawings in which.

DESCRIPTION OF A PREFERRED EMBODIMENT

Figure 1:
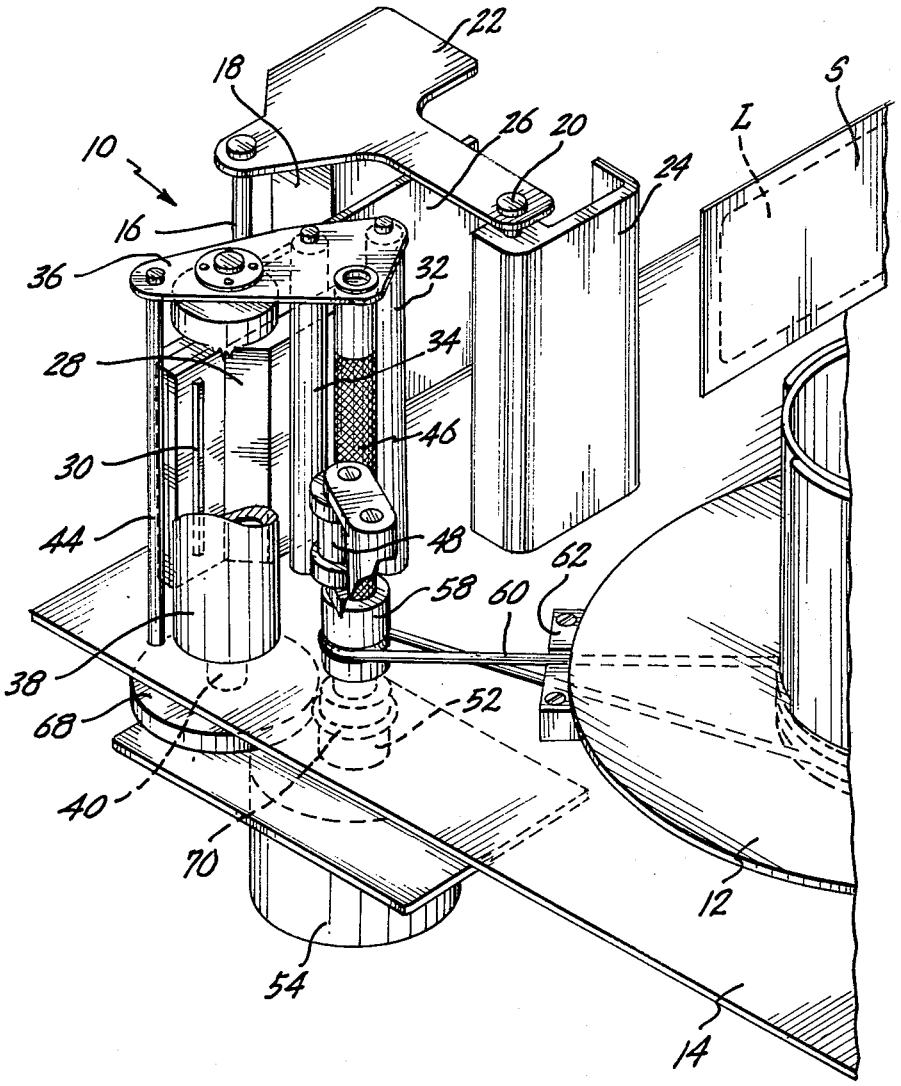
FIG. 1 is a pictorial view of a label printer including a mechanism accommodating both self-strip and nonspooling paths of label stock movement.
Figure 3:
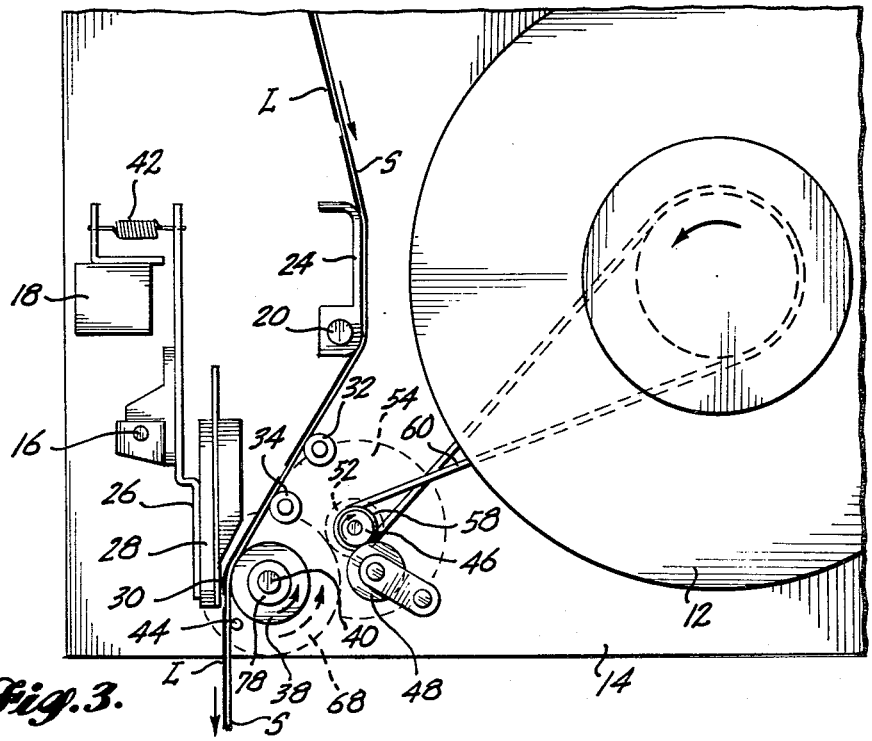
FIG. 3 is a plan view illustrating the nonspooling path of label stock movement through the printer of FIG. 1; and, FIG. 4 is a plan view illustrating the self-strip path of label stock movement through the printer of FIG. 1.
Figure 4:
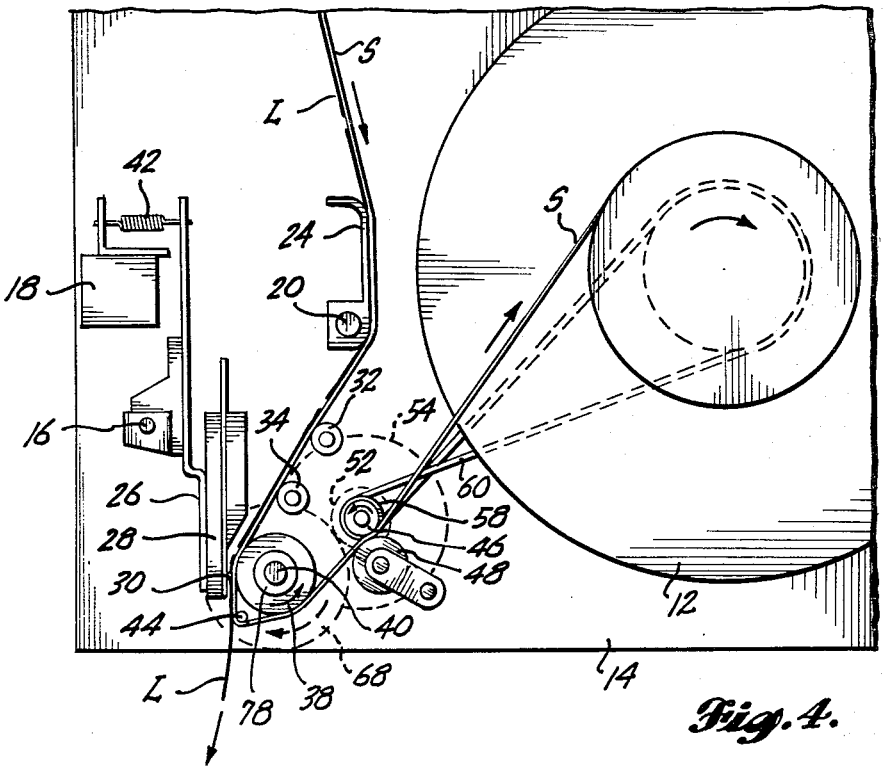

Referring now to FIG. 1, the invention will be described with reference to a thermal printer for printing bar code characters on label stock consisting of a plurality of labels removably adhering to an elongated strip of label stock backing. One of the labels L and the associated backing strip S are illustrated in FIG. 1 at a position where the label stock is just exiting from a supply spool of the printer, not illustrated. The major components of the printer illustrated in FIG. 1 are a mechanism, generally indicated by the reference numeral 10, and a take-up reel 12, both of which are supported by a deck 14 of the printer. During printing, the label stock moves from the position illustrated in FIG. 1 to and through mechanism 10. When the nonspooling path of label stock movement has been selected by the operator, both the labels L and the backing strip S exit from the mechanism 10 to the left in FIG. 1 without label separation, as illustrated in FIG. 3 and as discussed hereinafter. When the self-strip path of label stock movement has been selected by the operator, each label L is partially separated from the backing strip S as the label stock moves through mechanism 10 and the backing strip S then passes to and is wound up on take-up reel 12, as illustrated in FIG. 4 and as discussed hereinafter.

Mechanism 10 includes a pin 16, a block 18, and a pin 20, each disposed in proximity to the supply position of the label stock illustrated in FIG. 1. At their respective ends, pin 16, block 18 and pin 20 are secured to deck 14 and to an end plate 22 disposed above deck 14 so as to extend in a spaced, parallel relationship that is perpendicular to deck 14. A guide plate 24 is pivoted on pin 20, and a support plate 26 is pivoted on pin 16. Support plate 26 has secured thereto a conventional thermal print head 28 that includes an elongated thermal print element 30 of resistive material extending perpendicular to deck 14. Each label L includes a thermally responsive layer thereon that is exposed or darkened by the application of heat thereto, the heat being produced by energization of thermal print element 30 when the label L is in contact therewith so as to print an elongated bar whose extent corresponds to that of thermal print element 30.

During printing, the label stock is guided to and maintained in contact with thermal print element 30 and then caused to move in either the nonspooling path or the self-strip path in the following manner.

Guide pins 32 and 34 are successively disposed between guide plate 24 and thermal print element 30. At their respective ends, guide pins 32 and 34 are secured to deck 14 and to an end plate 36 disposed above deck 14 so as to extend in a spaced, parallel relationship that is perpendicular to deck 14. During label stock movement, the label stock follows a path from the supply position illustrated in FIG. 1 to the mechanism 10 so that the front surface of backing strip S bearing labels L rides over guide plate 24, so that the rear surface of backing strip S rides over guide pins 32 and 34, and so that the front surface of backing strip S faces thermal print head 28 and thermal print element 30 thereon. Facing thermal print element 30 is a drive roller 38 that is rotatable on or with a shaft 40, as described hereinafter. Shaft 40 is journalled in deck 14 and end plate 36 so as to extend perpendicular to deck 14 and thus parallel to thermal print element 30. Means are provided (such as tension spring 42 secured to block 18 and support plate 26, see FIGS. 3 and 4) for yieldably biasing thermal print head 28 towards drive roller 38 to maintain each label L in good thermal contact with thermal print element 30.

A label stripping pin 44 is disposed proximate to drive roller 38 at a location where the label stock exits from the points of contact between thermal print element 30 and drive roller 38, the label stripping pin 44 extending perpendicular to deck 14 and having its ends secured to deck 14 and end plate 36. A drive capstan 46 is disposed between drive roller 38 and take-up reel 12, with drive capstan 46 being journalled at one end in end plate 36 and extending above deck 14 perpendicular thereto. A pinch roller 48 is rotatably supported above and on deck 14 and is spring-biased (by means not illustrated) into engagement with drive capstan 46.

Figure 2:
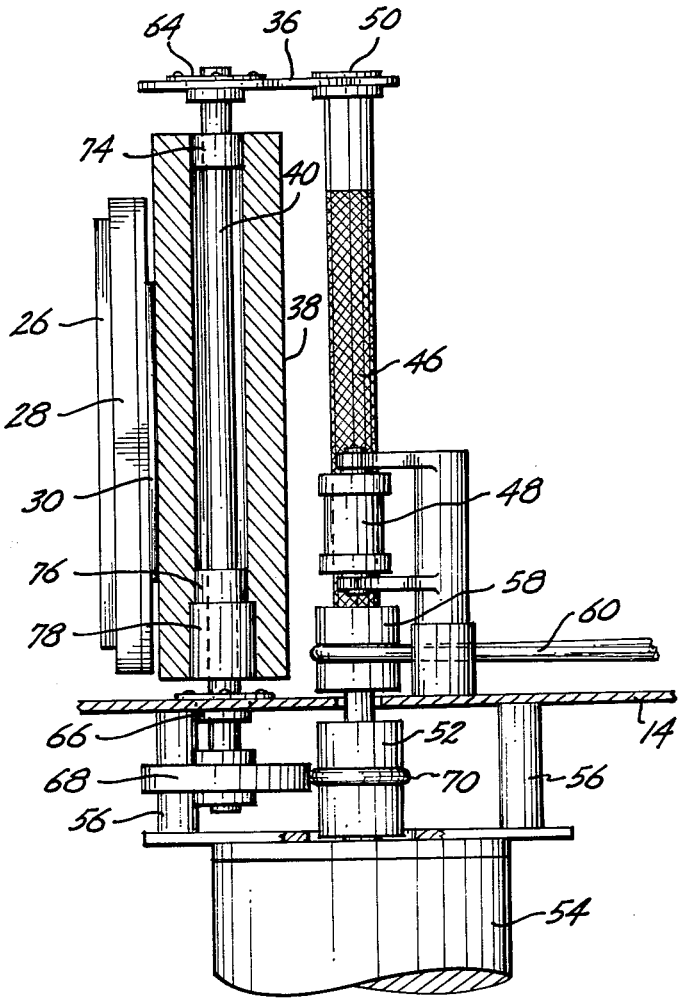
FIG. 2 is an elevation view of the mechansim of FIG. 1.

Referring additionally now to FIG. 2, drive capstan 46 is journalled in end plate 36 by a bearing 50. A portion of drice shaft 46 extends through and below deck 14 and is coupled by a disc 52 to the shaft of a drive motor 54 that is supported from deck 14 by a pair of standoffs 56. Above deck 14, drive capstan 46 carries a grooved disc 58 around which is passed an elongated spring 60 formed into an endless loop. Spring 60 crosses itself and passes around a corresponding grooved portion of take-up reel 12. The respective crossing portions of spring 60 are separated from each other by a guide 62 secured to deck 14 (see FIG. 1). As drive capstan 46 is rotated in a given direction by drive motor 54, take-up reel 12 accordingly rotates in an opposite direction. Shaft 40 is journalled in end plate 36 by a bearing 64 and in deck 14 by a bearing 66. A portion of shaft 40 extends below deck 14 and carries a disc 68. An O-ring 70 of elastomeric material is disposed about the periphery of disc 52 carried by drive capstan 46, with O-ring 70 engaging disc 68 carried by shaft 40. As drive capstan 46 is rotated in a given direction by drive motor 54, shaft 40 accordingly rotates in an opposite direction.

Drive roller 38 is seen in FIG. 2 to comprise a hollow cylinder of elastomeic material that is supported for rotation on shaft 40 by respective upper and lower bearings 74 and 76 press fit into roller 38. Immediately below lower bearing 76, an overrun clutch 78 is also press fit into roller 38 and rides on shaft 40. Overrun clutch 78 is of a type that permits drive roller 38 to freely rotate on shaft 40 when shaft 40 is rotating in a given direction, but that locks drive roller 38 to shaft 40 when shaft 40 is rotating in an opposite direction. A preferred overrun clutch is a roller bearing clutch, such as that available from The Torrington Company, Model No. RC-040708. As viewed in FIG. 1, overrun clutch 78 should be installed so that the clutch engages and locks drive roller 38 to shaft 40 when shaft 40 is rotating in a counterclockwise direction and so that the clutch disengages and permits drive roller 38 to free-spool when shaft 40 rotates in a clockwise direction.

The plan view of FIG. 3 illustrates the nonspooling path of label stock movement. The label stock is threaded past guide plate 24, guide pins 32 and 34, and between thermal print head 28 and drive roller 38 so that its free end exits the printer. Appropriate signals are supplied to drive motor 54 so that drive capstan 46 is rotated in a clockwise direction. Due to the engagement of discs 52 and 68 through O-ring 70, shaft 40 is caused to rotate in a counterclockwise direction, thereby engaging clutch 78 so that drive roller 38 also rotates in a counterclockwise direction. As a result, the label stock is moved from the supply position by the engagement of drive roller 38 and thermal print head 28 and thereby exits the printer without label separation.

The plan view of FIG. 4 illustrates the self-strip path of label stock movement. The label stock is threaded past guide plate 24 and guide pins 32 and 34, between drive roller 38 and thermal guide head 28, around label stripping pin 44, again over drive roller 38, between drive capstan 46 and pinch roller 48, and onto take-up reel 12, with the free end of the label stock being secured to take-up reel 12. Appropriate signals are supplied to drive motor 54 so that drive capstan 46 is rotated in a counterclockwise direction, i.e., a direction opposite to that used for the nonspooling path in FIG. 3. Due to spring 60, take-up reel 12 is accordingly rotated in a clockwise direction. Engaged discs 52 and 68 rotate shaft 40 in a clockwise direction, thereby disengaging clutch 78 and permitting drive roller 38 to free-spool on shaft 40. Backing strip S accordingly is pulled from the supply position by drive capstan 46 and its associated pinch roller 48 and subsequently wound up on take-up reel 12. As the label stock passes over label stripping pin 44, each label L is partially separated from backing strip S as the label stock sharply changes direction around label stripping pin 44. When each label has been partially separated, it may be completely removed by hand for application to a desired object.

It will therefore be appreciated that the invention provides a single mechanism that accommodates both nonspooling and self-strip paths of label stock movement in a label printer. In order to provide a desired path of label stock movement, it is only required to appropriately thread the label stock and to appropriately control the direction of rotation of the printer's drive capstan. Notwithstanding the path that has been selected, the printed labels may exit the printer immediately after printing. While the invention has been described with reference to a preferred embodiment, it is to be clearly understood by those skilled in the art that the invention is not limited thereto and that the scope of the invention is to be interpreted only in conjunction with the appended claims.

The embodiments of the invention in which an exclusive property or privilege is claimed are as follows:

1. In a label printer, a mechanism for providing selectable paths of movement of label stock that consists of a plurality of labels removably adhering to a front surface of an elongated backing strip, said mechanism comprising: a rotatable drive capstan; a rotatable pinch roller engaging said drive capstan; a rotatable shaft; drive means for rotating said drive capstan and said shaft in opposite directions; a drive roller rotatable about said shaft; clutch means for locking said drive roller to said shaft whenever said shaft is rotated in a given direction and for permitting said drive roller to freely rotate about said shaft whenever said shaft is rotated in an opposite direction; a label stripping pin; and, pressure means yieldably engaging said drive roller;

wherein said aforementioned elements of said mechanism are disposed so that the label stock may be moved in a nonspooling path by threading a free end of the label stock between said drive roller and said pressure means and by causing said drive means to rotate said drive capstan and said drive roller in a first set of opposing directions so that said drive roller is locked to said shaft, whereupon the label stock is pulled by said pressure means and said drive roller and exits without label separation; and, wherein said aforementioned elements of said mechanism are further disposed so that the label stock may be moved in a self-strip path by further threading the free end of the label stock past said label stripping pin and between said drive capstan and said pinch roller with a rear surface of the backing strip engaging said label stripping pin and with the backing strip being caused to sharply change its direction as it passes over said label stripping pin, and by causing said drive means to rotate said drive capstan and said drive roller in a second set of opposing directions so that said drive capstan and said pressure means pull the label stock and so that said drive roller freely rotates about said shaft, whereupon each label is partially separated from the backing strip as the backing strip passes over said label stripping pin.

2. The label printer of claim 1, wherein said drive roller and said pressure means are disposed so that the front, label-bearing surface of the backing strip is engaged by said pressure means and so that the rear surface of the backing strip is engaged by said drive roller.

3. The label printer of claim 2, wherein said pressure means includes a thermal print head having a thermal print element yieldably engaging said drive roller.

4. The label printer of claim 1, wherein said drive capstan and pinch roller are disposed so that the front surface of the backing strip is engaged by said pinch roller and so that the rear surface of the backing strip is engaged by said drive capstan.

5. The label printer of claim 1, wherein said label stripping pin, said drive roller, and said drive capstan and said pinch roller are disposed so that the rear surface of the backing strip is engaged by said drive roller as the backing strip passes from said label stripping pin to said drive capstan and said pinch roller.

6. The label printer of claim 1, further including: a rotatable take-up reel to which the free end of the label stock may be secured; and, means for causing said take-up reel to rotate with rotation of said drive capstan, said take-up reel being disposed so as to receive the label stock as the label stock exits from between said drive capstan and said pinch roller.

7. The label printer of claim 1, wherein said drive roller includes a hollow cylinder of elastomeric material surrounding said shaft.

8. The label printer of claim 7, wherein said drive roller further includes bearing means secured to said cylinder and surrounding said shaft for supporting said cylinder for rotation about said shaft.

9. The label printer of claim 8, wherein said bearing means is disposed within said cylinder.

10. The label printer of claim 7, wherein said clutch means includes an overrun clutch secured to said cylinder and surrounding said shaft.

11. The label printer of claim 10, wherein said overrun clutch is a roller bearing clutch.

12. The label printer of claim 10 or claim 11, wherein said clutch means is disposed within said cylinder.

13. The label printer of claim 1, wherein said clutch means includes an overrun clutch secured to said drive roller and surrounding said shaft.

14. The label printer of claim 13, wherein said overrun clutch is a roller bearing clutch.

15. The label printer of claim 1, wherein said drive means includes transmission means mechanically intercoupling said drive capstan and said shaft for rotation in opposite directions.

16. The label printer of claim 15, wherein said transmission means includes: a first disc secured to and rotatable with one of said drive capstan and said shaft; a second disc secured to and rotatable with the other of said drive capstan and said shaft; and, an elastomeric O-ring carried by the periphery of said second disc and engaging the periphery of said first disc.

17. The label printer of claim 16, wherein said first disc is secured to and rotatable with said shaft and wherein said second disc is secured to and rotatable with said drive capstan.

18. The label printer of claim 17, wherein said drive means further includes a drive motor coupled to said drive capstan.

19. The label printer of claim 15, wherein said drive means further includes a drive motor coupled to one of said drive capstan and said shaft.

* * * * *

UNITED STATES PATENT AND TRADEMARK OFFICE

CERTIFICATE OF CORRECTION

PATENT NO. : 4,432,830

DATED : February 21, 1984

INVENTOR(S) : Clifford T. Jue

It is certified that error appears in the above-identified patent and that said Letters Patent is hereby corrected as shown below:

| | | |
|---|---|---|
| Column 2, | line 25: | Delete --drive roller-- |
| | line 25: | Insert --shaft-- after "the" |
| | line 36: | Delete --drive-- (2nd occurrence) |
| | line 37: | Delete --roller-- |
| | line 37: | Insert --shaft-- before "in" |
| Column 4, | line 29: | "drice" should be --drive-- |
| | line 50: | "elastomeic" should be --elastomeric-- |
| Column 6, | line 6: | Delete --drive-- (2nd occurrence) |
| | line 7: | Delete --roller-- |
| | line 7: | Insert --shaft-- before "in" |
| | line 22: | Delete --drive roller-- |
| | line 22: | Insert --shaft-- after "said" |

Signed and Sealed this

*Eighteenth* Day of *September 1984*

[SEAL]

*Attest:*

GERALD J. MOSSINGHOFF

*Attesting Officer*

*Commissioner of Patents and Trademarks*